US008226440B2

(12) United States Patent
Mouchon et al.

(10) Patent No.: US 8,226,440 B2
(45) Date of Patent: Jul. 24, 2012

(54) LIGHTING SYSTEM AND CAP FOR SUCH LIGHTING SYSTEM

(75) Inventors: Arnaud Mouchon, Paris (FR); Philippe De Montureux, Versailles (FR); Jelle Pelsma, Chartres (FR); Antonius Nicolaas Theelen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 167 days.

(21) Appl. No.: 12/867,281

(22) PCT Filed: Feb. 18, 2009

(86) PCT No.: PCT/IB2009/050657
§ 371 (c)(1),
(2), (4) Date: Aug. 12, 2010

(87) PCT Pub. No.: WO2009/104140
PCT Pub. Date: Aug. 27, 2009

(65) Prior Publication Data

US 2010/0311267 A1 Dec. 9, 2010

(30) Foreign Application Priority Data

Feb. 19, 2008 (EP) ..... 08300103

(51) Int. Cl.
*H01R 5/54* (2006.01)

(52) U.S. Cl. ..... 439/617

(58) Field of Classification Search ..... 439/617, 439/918, 699.2, 276, 936
See application file for complete search history.

(56) References Cited

U.S. PATENT DOCUMENTS

| | | | | |
|---|---|---|---|---|
| 5,465,025 | A | 11/1995 | Hendrickson | |
| 7,025,490 | B1 | 4/2006 | Tseng | |
| 7,284,895 | B2 * | 10/2007 | Goto | 362/645 |
| 7,306,488 | B2 * | 12/2007 | Krijne et al. | 439/617 |
| 2006/0187682 | A1 * | 8/2006 | Goto | 362/652 |
| 2010/0311267 | A1 * | 12/2010 | Mouchon et al. | 439/375 |

FOREIGN PATENT DOCUMENTS

| | | | |
|---|---|---|---|
| DE | 29924240 | U1 | 9/2002 |
| DE | 102004029238 | A1 | 1/2005 |
| EP | 1672276 | | 6/2006 |
| WO | 2004015331 | A1 | 2/2004 |
| WO | 2007105144 | A1 | 9/2007 |
| WO | 2007141236 | | 12/2007 |

* cited by examiner

*Primary Examiner* — Tulsidas C Patel
*Assistant Examiner* — Phuongchi Nguyen
(74) *Attorney, Agent, or Firm* — Mark L. Beloborodov

(57) ABSTRACT

A lighting system comprising an electrical lamp (6) having an electrical lamp connector (32), a holder (5) having a front electrical connector adapted to be back-connected to a power supply and a cap (7) to interface the electrical lamp and the holder, said cap extending along a mounting direction between a top side for receiving the lamp connector and an opposite bottom side for receiving the holder connector, and having axial holes extending between the bottom side and the top side for receiving within at least a part of an electrical cap connector able to electrically connect the lamp connector with the holder connector once the lighting assembly is assembled. The cap further comprises a cap guide and the holder further comprises a holder guide, said cap guide and holder guide being adapted to cooperate with one another by fitting in the mounting direction, such that any significant motion of the cap into directions perpendicular to the mounting direction is prevented by the holder guide, ensuring a positioning step of the cap with respect to the holder before an electrical contacting step of the cap connector with the holder connector.

6 Claims, 9 Drawing Sheets

LIGHTING SYSTEM AND CAP FOR SUCH LIGHTING SYSTEM

TECHNICAL FIELD

The present invention generally relates to lighting systems and caps and capped lamps for such lighting systems.

BACKGROUND OF THE INVENTION

More precisely, the invention concerns a lighting system for mounting an electrical lamp onto a power supply, comprising:

an electrical lamp having an electrical lamp connector, a holder having a front electrical connector adapted to be back-connected to a power supply, a cap to interface the electrical lamp and the holder, extending along a mounting direction between a top side for receiving the lamp connector and an opposite bottom side for receiving the holder connector, and having axial holes extending between the bottom side and the top side for receiving within at least a part of an electrical cap connector able to electrically connect the lamp connector with the holder connector once the lighting system is assembled;

wherein the cap and holder have attached means adapted to cooperate with one another in the mounting direction so as to mount and electrically connect the cap with the holder.

A lighting system of this type is disclosed for instance in WO-A-2004/015331.

Although the lighting system which is described in this document is satisfactory, a general need with lighting systems of this type is to avoid that an electrical connection of the cap to the holder may fail and result in jamming of the cap on the holder.

SUMMARY OF THE INVENTION

An object of the present invention is to propose such improvement.

To this end, according to one embodiment of the invention, a lighting system is proposed for mounting an electrical lamp onto a power supply, comprising:

the electrical lamp having an electrical lamp connector, a holder having a front electrical holder connector adapted to be back-connected to a power supply, a cap interfacing the electrical lamp and the holder, having a cap body extending along a mounting direction between a top side for receiving the lamp connector and an opposite bottom side for receiving the holder connector and having axial holes extending between the bottom side and the top side for receiving within at least a part of an electrical cap connector able to electrically connect the lamp connector with the holder connector once the lighting system is assembled;

The cap has further a cap guide and the holder has further a holder guide, said cap guide and holder guide being adapted to cooperate with one another in the mounting direction when the holder is connected to the cap.

The cap guide and holder guide are more especially designed to fit together and guide the cap in translation along said mounting direction such that any significant motion of the cap into directions perpendicular to the mounting direction is prevented by the holder guide, ensuring a positioning step of the cap with respect to the holder before an electrical contacting step of the cap connector with the holder connector.

Thanks to these features, the cap guide and holder guide provide a simple an efficient guiding of the cap relative to the holder during montage of the cap onto the holder, which allows the user well-positioning the cap with respect to the holder for the next electrical connection (i.e. align the cap connector with the holder connector along the mounting axis), and ensure then a good electrical connection between the cap and the holder.

The electrical connection safety between the cap and the holder is thus improved.

This improvement is particularly interesting if the holder is fixed to a vehicle, and if the user has to change the capped lamp (i.e. lamp+cap). The invention improves the safety of this operation for the user and for the vehicle electrical system.

In various embodiments of the lighting system of the invention, one may have recourse to one and/or other of the following features:

said cap guide extends from the said bottom side parallel to the mounting direction. The width of the cap (a width of the cap being measured in a plan perpendicular to the mounting axis) is thus minimized. The lighting system is thus less cumbersome, which may be of a great interest for vehicle manufacturers who may therefore reduce the size or provide new optical systems in headlights and/or back-up lights; additionally, this feature allows also reducing the width of the holder;

said cap guide includes one female or male guide member and the holder guide includes the complementary guide member;

said cap guide includes two guide members which are two males, two females or one female and one male guide members, and the holder guide includes the complementary guide members;

said cap guide and holder guide include complementary reliefs which are adapted to fit together and provided for coding respectively a capped lamp-type and a holder-type for avoiding improper pairing of a capped lamp (i.e. lamp+cap) onto the holder; thus it is ensured that the capped lamp is mounted onto the holder in a right position;

said cap and holder are made out of electrically insulating material; especially, the cap guide and holder guide are made of an electrically insulating material: this ensures that no electrical problems occur during the positioning of the cap onto the holder—i.e. the function of mounting are separated from the function of electrical connection;

said male guide members are legs belonging to the cap main body and protruding toward the holder further than said cap connector, and said female guide members are lateral grooves formed in said holder main body and adapted to receive respectively said legs; this feature enables to guide the cap on the holder in a particularly simple and efficient way, while ensuring that the cap is guided relatively to the holder at least until the cap and the holder are electrically connected;

said legs and grooves include complementary reliefs which are adapted to fit together and adapted to code respectively a cap type and a holder type for avoiding improper pairing of the cap and holder;

said cap main body and holder main body are made out of electrically insulating material;

said holder further includes an additional electrical connector which is electrically connected to said holder connector and is adapted to be back-connected to a power supply;

the lamp is irremovably received onto the cap and the cap is removably mounted onto the holder;

the lighting system further includes a housing having a wall on which said holder main body is fixed, said lamp being situated inside said housing;

the cap and the holder comprises mounting means arranged for locking the cap onto the holder once the electrical contacting step occurs.

Besides, a further embodiment of the invention concerns a lamp cap for a lighting system comprising:

an electrical lamp having an electrical lamp connector, a holder having a holder guide and a front electrical holder connector adapted to be back-connected to a power supply; said lamp cap comprising:

a cap main body having a top side for receiving the electrical lamp, an opposite bottom side for receiving the holder connector, and axial holes extending between the bottom side and the top side for receiving within at least a part of an electrical cap connector, a cap guide adapted to cooperate with the holder guide in a mounting direction when the cap is mounted onto the holder, wherein said cap guide is designed to fit with the holder guide to be guided in translation along said mounting direction such that any significant motion of the lamp cap into directions perpendicular to the mounting direction is prevented by the holder guide, ensuring a positioning step of the lamp cap with respect to the holder before an electrical contacting step of the cap connector with the holder connector.

In various embodiments of the lamp cap of the invention, one may have recourse to one and/or other of the following features:

said cap guide extends from the said bottom side parallel to the mounting direction; particularly, said cap guide may extend from edge of the said bottom side; more particularly said cap guide may comprise guide members whose volume for each one is limited by large faces and small faces parallel the X-axis, one of the large surfaces of each guide member extends from the edge of the said bottom side; The width of the cap is thus minimized. The lighting system is thus less cumbersome, which may be of a great interest for vehicle manufacturers who may therefore reduce the size or provide new optical systems in headlights and/or back-up lights; furthermore, this reduction of cap size is very useful for systems where the holder (fixed to the vehicle) is difficult or impossible to access for the user with cap of prior art;

said cap guide are 1, 2, 3 or more legs, provided for example the rigidity and/or the legs thickness required;

said lamp cap further comprises an electrical cap connector able to electrically connect the lamp connector with the holder connector, via the axial holes;

said surface includes relief which is adapted to fit with complementary relief of the holder guide and adapted to code a capped lamp-type for avoiding improper pairing of the capped lamp (i.e. electrical lamp+lamp cap) and holder;

one of said cap guide includes two legs protruding further than said second cap connector in the mounting direction;

At last, a further embodiment of the invention concerns a capped lamp comprising the said lamp cap and an electrical lamp having an electrical lamp connector electrically interfacing the lamp and the lamp cap.

BRIEF DESCRIPTION OF THE DRAWINGS

Other features and advantages of the invention appear from the following detailed description of one of its embodiments, given by way of non-limiting example, and with reference to the accompanying drawings.

In the drawings.

DETAILED DESCRIPTION OF EMBODIMENTS

Figure 1:
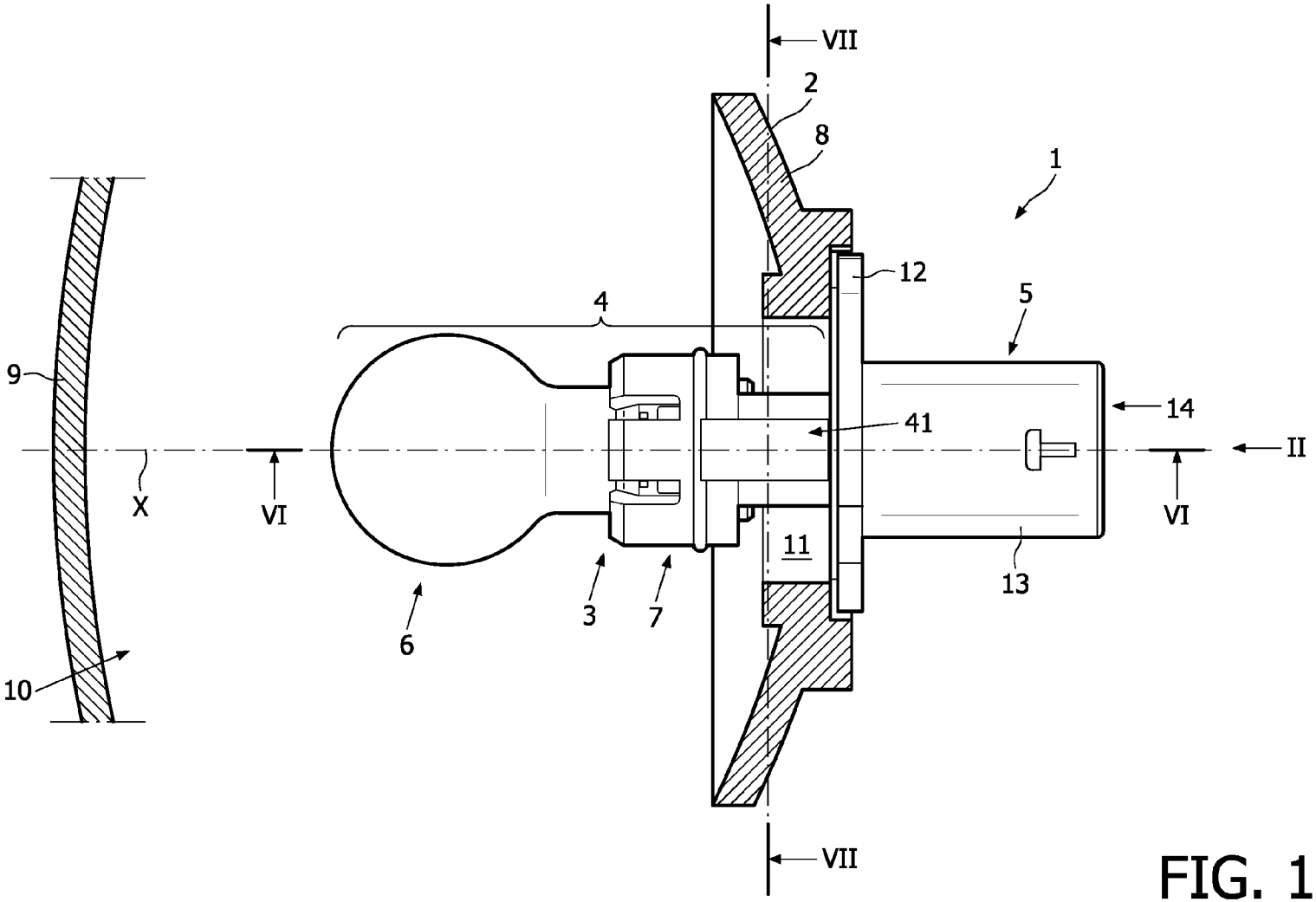
FIG. 1 is a schematic view of a lighting system according to one embodiment of the invention, including capped lamp assembly mounted in a housing.
Figure 2:
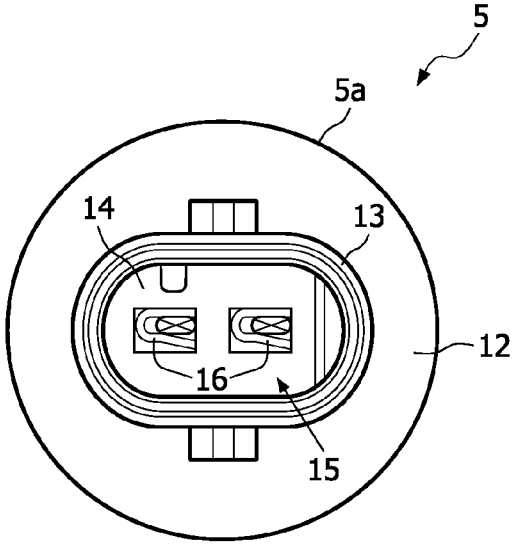
FIG. 2 is a rear view of the capped lamp assembly of FIG. 1, viewed in the direction II of FIG. 1.
Figure 3:
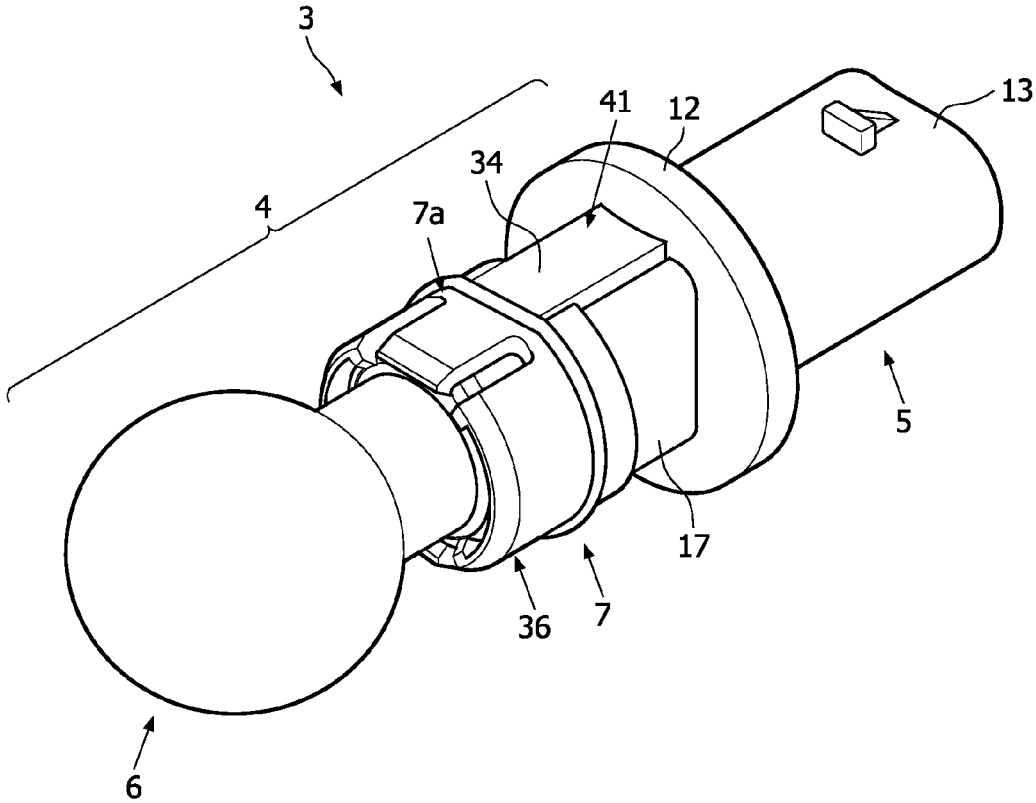
FIG. 3 is a perspective view of the capped lamp assembly of FIG. 1.

In the various drawings, the same reference numerals designate identical or similar elements.

FIG. 1 shows a lighting system 1, designed to be used for instance in an automotive vehicle. The lighting system may be for instance one of the headlamps of the vehicle, or a rear lamp, or else.

The lighting system 1 includes a housing 2 in which a capped lamp assembly 3 is mounted.

The capped lamp assembly comprises a capped lamp 4 connected to a holder 5. The capped lamp 4 comprises itself an electrical lamp 6 connected to a cap 7, said cap 7 being connected to the holder 5.

The electrical lamp 6 may be of any type, such as for example an incandescent or halogen lamp.

It should be noted that, although the lighting system 1 includes the housing 2, the holder 5, the lamp 6 and the cap 7 as used in the description in the FIGS. 1-9, this expression may refer more generally to part of these elements, for instance only the cap 7 and the holder 3.

The housing 2 may include a back wall 8, for instance a reflector and a front wall 9, for instance a lens, which define together an internal volume 10 in which the capped lamp 4 is located. The back wall 8 includes a hole 11 which is traversed by the capped lamp assembly 3, and in which the main body 5*a* of the holder 5 is fixed.

The holder main body 5*a* may for instance be made out of electrically insulating material, preferably in a single part, e.g. molded out of plastic material like thermoplastic resin such as for example polyamide. This material can withstand the relatively high temperatures generated by the lamp 6 in use.

In the example of the drawings, the holder main body 5*a* has a peripheral flange 12 which extends radially outwardly relative to a central X-axis of the capped lamp assembly 3, and said flange 12 is fixed in the hole 11 by any known means, for instance by tight fitting.

As shown in more details in FIGS. 2-5, the holder main body 5*a* further includes a rear portion 13 which has a substantially cylindrical form (of oblong cross-section in this particular case), extending rearwardly along X-axis up to an open rear end 14 which contains a rear electrical connector 15. The rear connector 15 includes for instance two metallic pins 16 extending parallel to X-axis and accessible through the open rear end 14 so as to permit connection of the connector 15 to an external connector (not shown) belonging to a power supply circuit of the vehicle.

The holder main body 5*a* further includes a front portion 17 which extends forward of the flange 12 and which may for instance have an outer shape which is substantially cylindrical of X-axis and of substantially square section.

Figure 4:
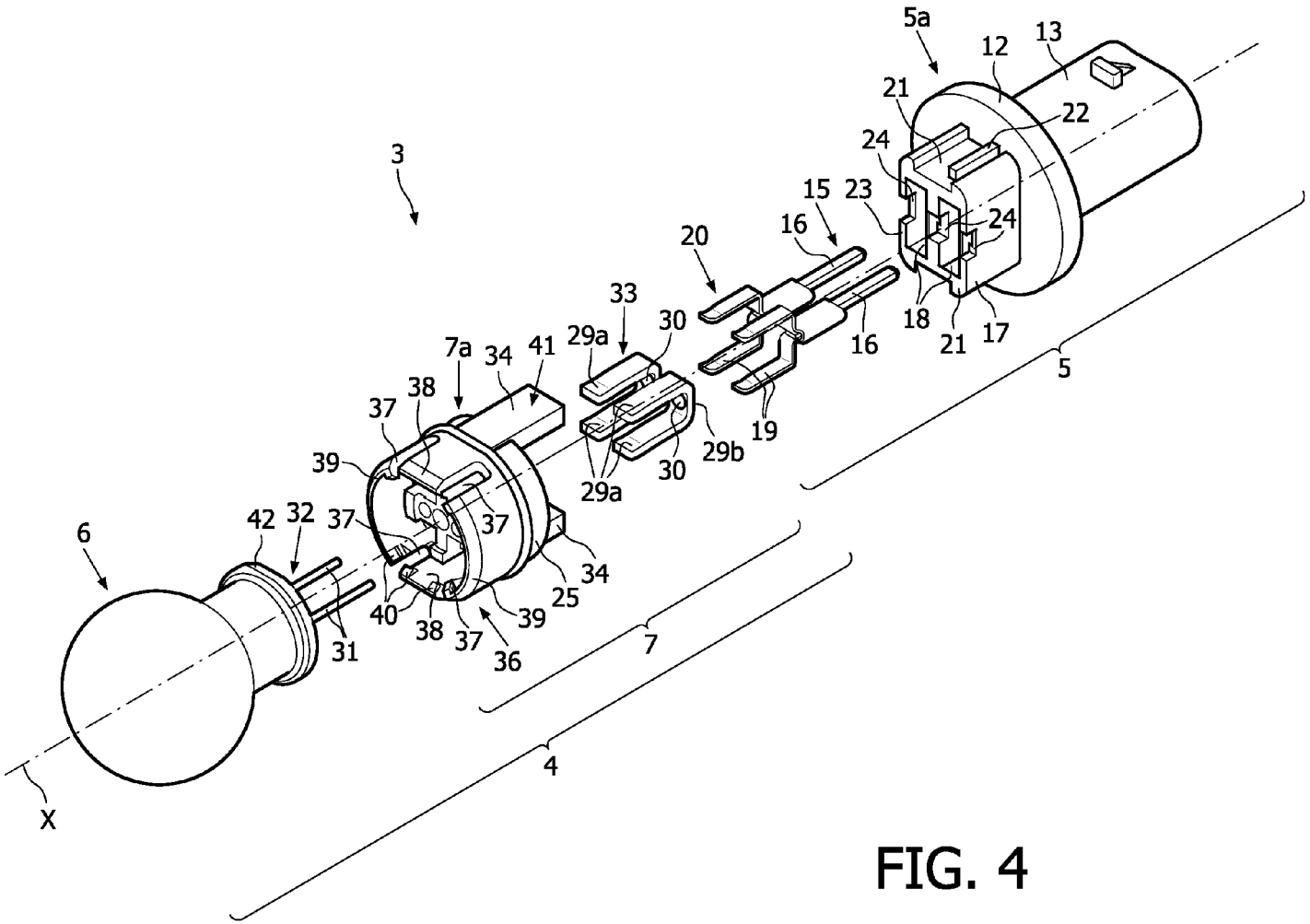
FIGS. 4 and 5 are exploded perspective views of the capped lamp assembly of FIG. 3, viewed in two opposite directions.
Figure 5:
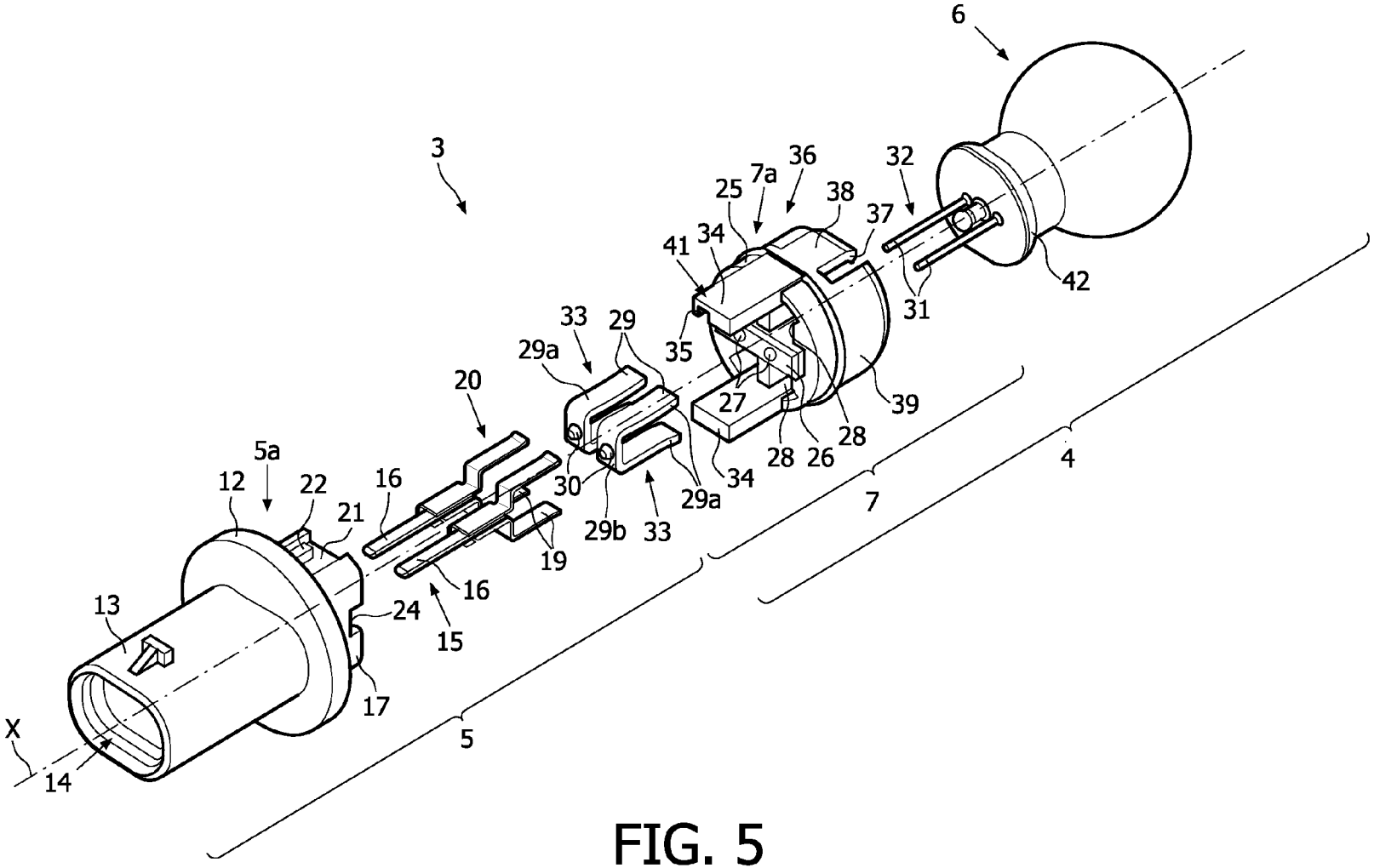
Figure 6:
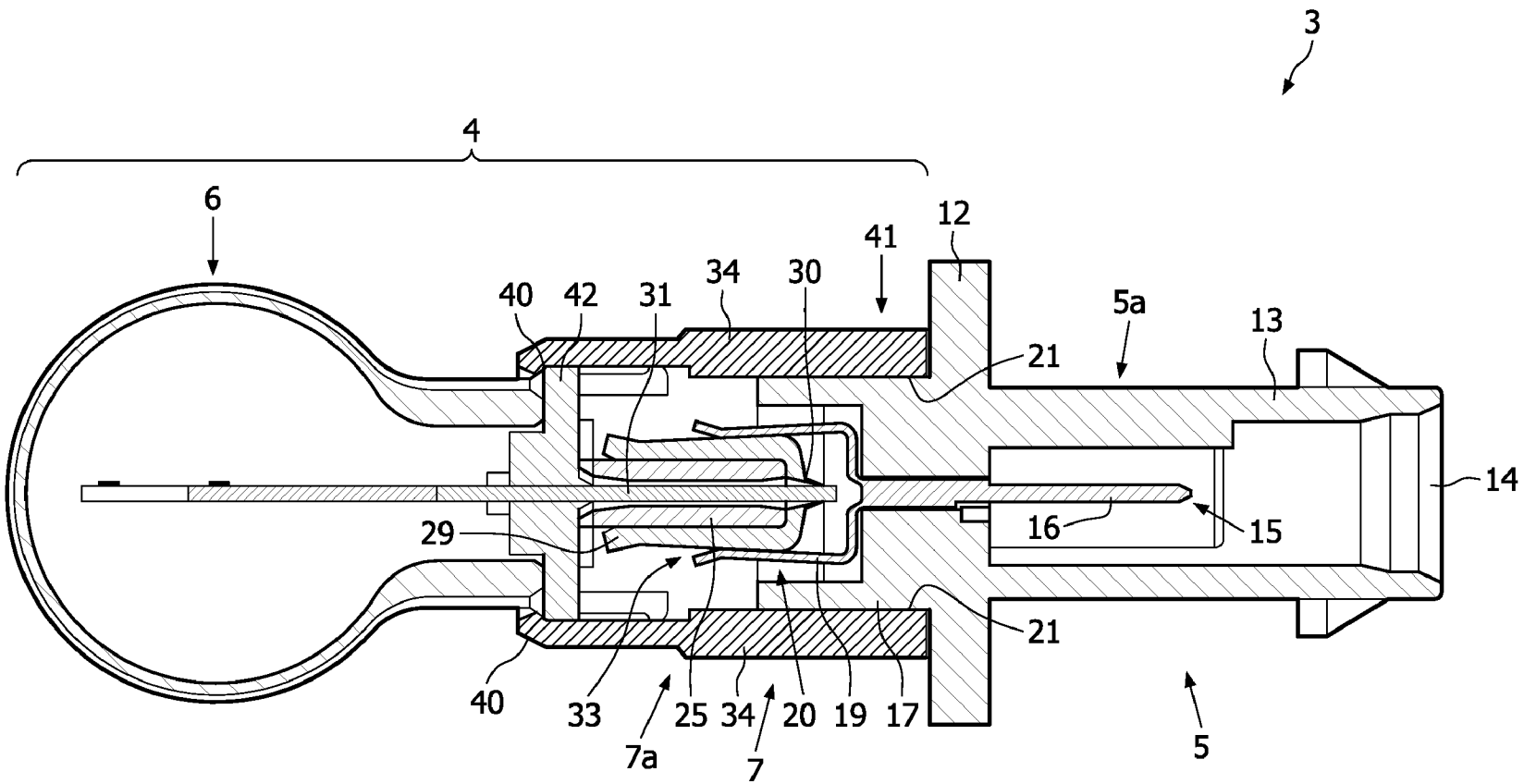
FIGS. 6 and 7 are section views, taken respectively along lines VI-VI and VII-VII of FIG. 1.
Figure 7:
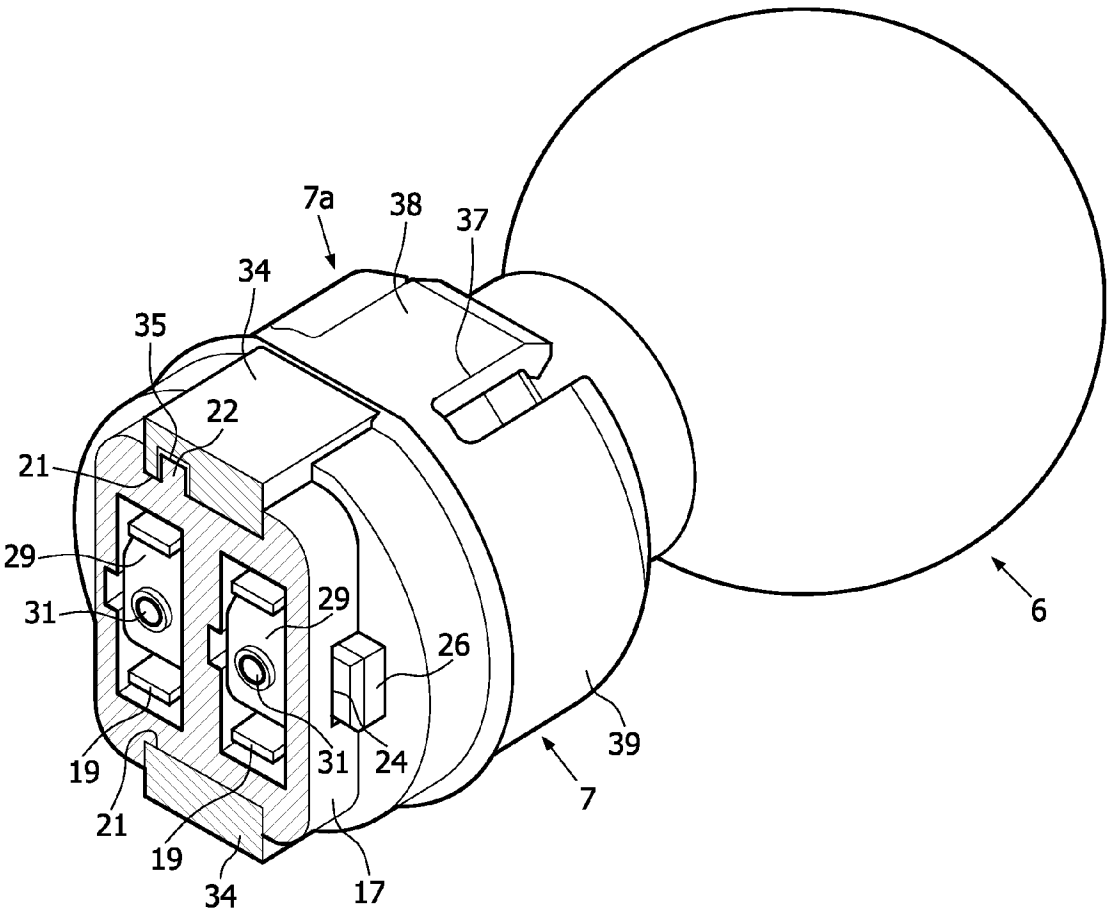

As shown on FIGS. 4 and 5, the front portion 17 of the holder main body 5*a* may include two central recesses 18 extending parallel to X-axis and open in the forward direction, i.e. toward the cap 7 and the lamp 6. These recesses 18 may accommodate respectively two metallic contact forks 19 which are also open in the forward direction and which form together a front holder connector 20.

Each of the forks 19 is unitary with a respective one of the pins 16, so that the holder connector 20 is in permanent electrical contact with the rear connector 15.

The front portion 17 of the holder main body 5*a* further includes, on two opposite sides thereof, a holder guide, which consist in the example of the drawings in two lateral grooves 21 parallel to X-axis.

Further, an axial rib 22, parallel to X-axis, may be provided in at least one of the lateral grooves 21.

Finally, edges of the end face 23 of the front portion 17 of the holder main body 5*a* may also include mutually aligned notches 24.

The cap 7 has a cap main body 7*a* which may be made out of an electrically insulating material, preferably in a single part, e.g. molded out of plastic material like thermoplastic resin such as for example polyamide. This material can withstand the relatively high temperatures generated by the lamp 6 in use.

The cap main body 7*a* includes a central portion 25 which comes in axial abutment against the end face 23 of the front portion 17 of the holder main body 5*a* when the cap 7 is connected to the holder 5 (see FIGS. 4-7).

A rib 26 transverse to the X-axis may extend outwardly the front face of the central portion 25 such that the two ends of this transverse rib 26 protrudes from the central portion 25 (if axially projected on the latter) and fits into the notches 24 of the holder when the cap is connected to the holder.

The transverse rib 26 is traversed by two axial holes 27, the utility of which will be explained later.

Further, the central portion 25 of the cap main body 7*a* includes two pairs of recesses 28 which open rearward and in which two U-shaped metallic contact members 29 are force fitted.

The U-shaped contact members are disposed so that their branches 29*a* are respectively force fitted in the recesses 28, while their bases 29*b* cover the transverse rib 26 rearward. When the cap is connected to the holder, the U-shaped contact members 29 are inserted in the forks 19 of the holder connector 20.

Further each of the bases 29*b* of the U-shaped contact members 29 includes a hole 30 which is parallel to X-axis. The two respective holes 30 of the U-shaped contact members 29 are in register with the holes 27 of the cap main body 7*a*, and these holes 30 are adapted to receive respectively two metallic pins 31 of the electrical lamp 6 when the lamp is connected to the cap 7.

Thus, the two holes 30 constitute a first electrical cap connector of the cap, which is able to be connected to the lamp connector 32 formed by the two pins 31 of the lamp, while the branches 29*a* of the U-shaped contact members constitute a second electrical cap connector 33 which is electrically connected to the first cap connector 30 and which is adapted to be electrically connected to the holder connector 20.

The cap main body 7*a* also includes a bottom side 41 which extends backward from the central portion 25 parallel the X axis. The bottom side 41 has a cap guide, which consists in the example of the drawings in two lateral legs 34, having a shape which is complementary to the lateral grooves 21 of the holder, extend rearward from the central portion 25 of the cap main body. Theses two lateral legs are adapted to fit, without or with a small clearance, in the two grooves 21 of the holder, for providing guidance to the cap 7 when the cap is mounted on the holder and for providing efficient and reliable support to the cap once it is mounted on the holder. One of the two legs 34 includes an axial slot 35 on the inner surface thereof, so that the axial rib 22 of the holder may fit into said axial slot 35, as clearly shown on FIG. 7.

As shown on FIGS. 4-7, the cap main body 7*a* also includes a top side 36 forming a hollow socket extending forward in the direction of the lamp 6. This front portion 36 includes a substantially cylindrical, peripheral wall which is interrupted by four slots 37, so that said peripheral wall forms four resilient tabs 38, 39. These resilient tabs 38, 39, include, at their free end, a plurality of inner edges 40. When the lamp 6 is connected to the cap 7, the resilient tabs 38, 39 are snap-fitted on a rim 42 formed at the basis of the lamp 6, so that the inner edges 40 of the resilient tabs 38, 39 may cooperate with said rim 41 to retain the lamp 6 irremovably on the cap 7.

Figure 10:
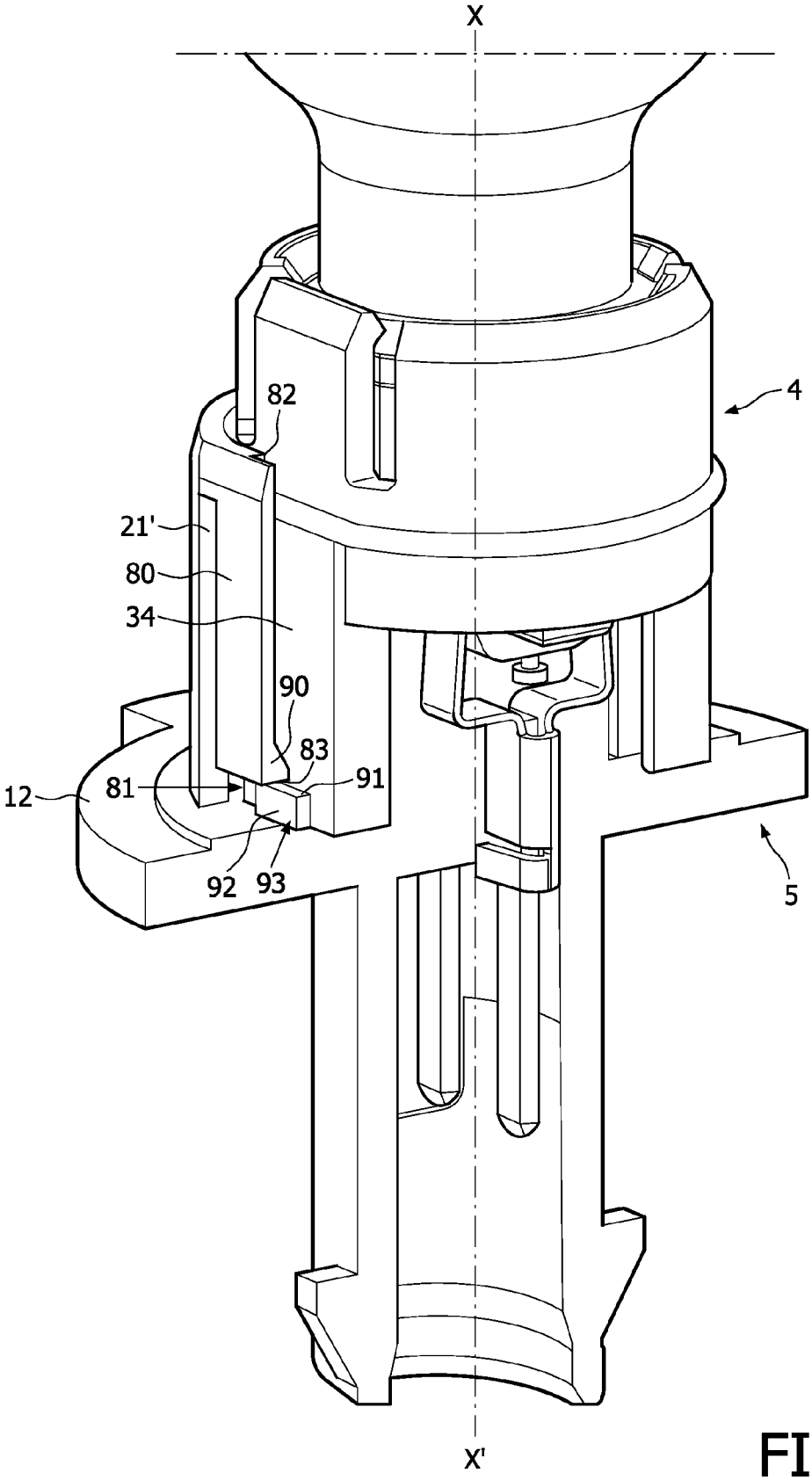
FIG. 10 is a 3D cross-section of the lighting system along line VI-VI, showing means for retaining the capped lamp onto the holder.

The capped lamp 4 is removably retained onto the holder 5 by locking means. The skilled person can use any known and well-known technique for providing this locking means. One example of locking means is depicted in FIG. 10: the holder 5 is provided with one flexible tab 80 extending from one of the two lateral edges of each groove 21 of the holder 5 so as to cover a part of the corresponding lateral leg 34 of the capped lamp 4 once the leg 34 is fitted within the groove 21. Furthermore a gap 81 is provided between this flexible tab 80 and the flange 12 of the holder 5, and the end of the flexible tab 80 adjacent the gap 81 is provided with a front wall 83 and a rear ramp 90 extending outwardly from the front wall 83 and from the X-axis. Additionally, the outer surface of the ended part of each lateral tab 34 is provided with a protruding part 92 able to be housed by the gap 81 and having a rear wall 91 able to abut the front wall 83 when the lateral tab 34 is abutting the flange 12, and a front wall or a front ramp 93. A recess 82 may also be provided onto each flexible tab 80, extending parallel the X-axis and on the whole length of the inner surface of each flexible tab 80 so as to allow a path to the protruding part 92 of the lateral tab 34 during the montage of the capped lamp 4 onto the holder 5. The lighting system which has been described above may be operated as follows.

The lamp 6 and cap 7 may be connected together in advance, thus forming the above-mentioned capped lamp 4. It should be noted that, thanks to the use of the cap 7, the lamp 6 may be manufactured in large series and connected to several types of caps 7, depending on the holder 5 on which the lamp is meant to be mounted.

Figure 8:
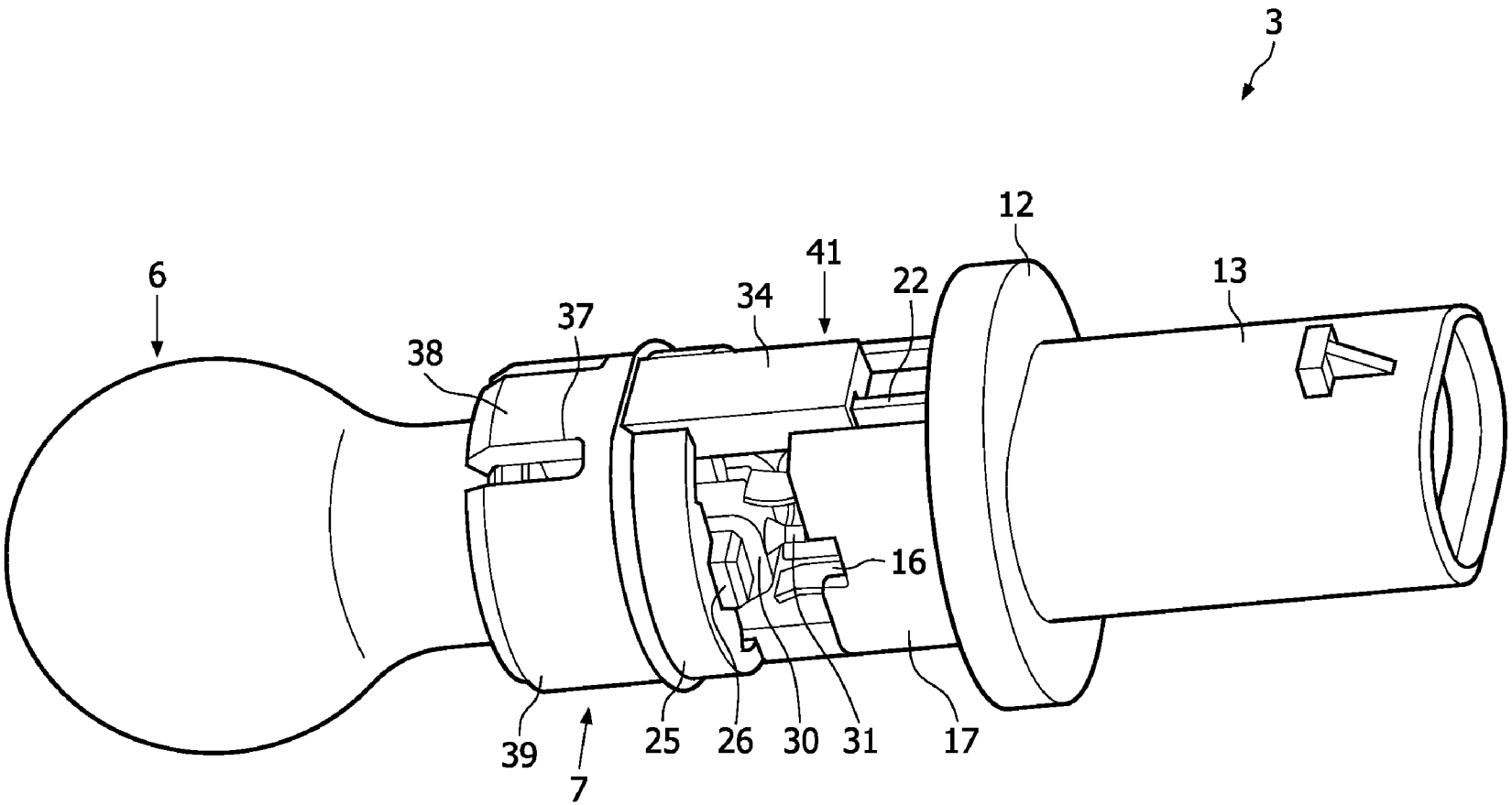
FIG. 8 is a perspective view showing the capped lamp assembly in an intermediate position during connection of the capped lamp to the holder.
Figure 9:
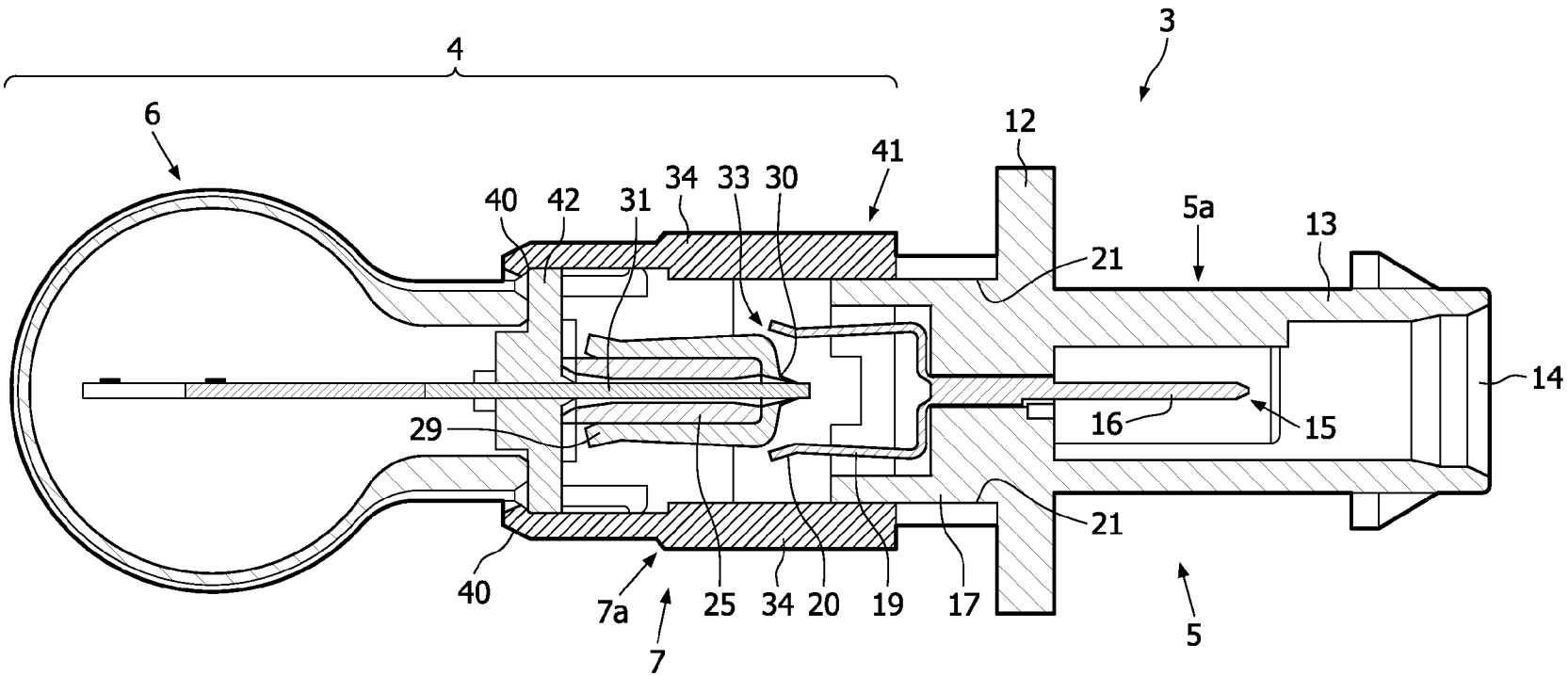
FIG. 9 is a section view along line VI-VI, showing the capped lamp assembly in the position of FIG. 8 during connection of the capped lamp to the holder.

When the capped lamp 4 is mounted on the holder 5, as shown on FIGS. 8 and 9, the cap guide formed by the two legs 34 of the cap 7 is at first fitted in the holder guide formed by the two lateral grooves 21 of the holder, and then the cap guide can slide forward along the mounting direction in the holder, at least until the second cap connector 30 be in electric contact with the holder connector 20.

Therefore, the cap lamp is very precisely guided in translation along the mounting direction (X-axis) at least until the cap lamp is electrically connected to the holder. This guidance avoids significant motion into directions perpendicular to the mounting direction.

After the electric contact between the second cap connector 30 and the holder connector 20, the capped lamp 4 continues to slide forward along the mounting direction (X-axis), until the free ends of the two legs 34 of the cap 7 comes up against the flange 12. In this position, the protruding part 92 (see FIG. 10) of each lateral tab 34 went beyond the rear ramp 90 and front wall 83 of the flexible tab 80 and is housed by the gap 81. The abutment between the rear walls 91 and front walls 83 prevents from a dismounting of the capped lamp 4 from the holder 5 if it is attempted to pull the capped lamp along the X-axis. But the capped lamp 4 is still dismountable, by firstly bearing back the flexible tab 80 from the X-axis and secondly by pulling the capped lamp 4 away from the holder 5. It is to be noticed that, before the locking position, each protruding part 92 slides into the recess 82 of the corresponding flexible tab 80 such that the flexible tab 80 is not strained by the guiding of the capped lamp 4 onto the holder 5, and thus the quality of positioning of the capped lamp 4 with respect to the holder 5 is not perturbed by these locking elements.

Further, the axial rib 22 of the holder and the axial slot 35 of the cap (or any other corresponding reliefs of the cap and holder which would fit together in sliding relationship along X-axis during connection of the capped lamp to the holder) are adapted to code respectively the cap type of the holder type, for avoiding improper pairing of the cap and holder.

Of course, this invention is not limited to the preceding detailed description, and can be extended to other lighting systems with a cap having the same or similar functionalities. For example, the skilled person knows how adapting the lighting system for having one, three, four or more lateral legs 34 as well as their complementary parts on the holder 5.

The invention claimed is:

1. A lighting system for mounting an electrical lamp having an electrical lamp connector onto a power supply, the system comprising:

a holder comprising
- a holder body,
- a holder guide comprising a first electrically insulating material, and
- a front electrical holder connector configured to be back-connected to the power supply, a cap interfacing with the electrical lamp and the holder and comprising
- a cap body extending along a mounting direction between a top side for receiving the lamp connector and an opposite bottom side for receiving the holder connector and having axial holes extending between the bottom side and the top side for receiving at least a part of an electrical cap connector for electrically connecting the lamp connector with the holder connector once the lighting system is assembled; and
- a cap guide comprising a second electrically insulating material, wherein both the cap guide and the holder guide have no mechanical contact with any of said connectors during and after assembly of the lighting system and wherein the cap guide and holder guide are configured to fit together and guide the cap in translation along said mounting direction while limiting movements of the cap into directions perpendicular to the mounting direction, thereby facilitating positioning of the cap with respect to the holder before electrically contacting the cap connector with the holder connector.

2. A lighting system according to claim 1, wherein said cap guide includes one female or male guide member and the holder guide includes the complementary guide member.

3. A lighting system according to claim 1, wherein said cap guide includes two guide members which are either two males, two females or one female and one male guide members, and the holder guide includes the complementary guide members.

4. A lighting system according to claim 1, wherein said cap guide and holder guide define complementary reliefs for coding respectively a capped lamp-type and a holder-type for avoiding improper pairing of a capped lamp onto the holder.

5. A lighting system according to claim 1, wherein the lamp is permanently received onto the cap and the cap is removably mounted onto the holder.

6. A lighting system according to claim 1, wherein the cap and the holder comprises mounting means arranged for locking the cap onto the holder once the electrical contacting step occurs.

* * * * *